United States Patent [19]

Wilmeth

[11] 4,132,136

[45] Jan. 2, 1979

[54] POWER WRENCH FOR TURNING THREADED CONNECTION MEMBERS

[75] Inventor: Claude H. Wilmeth, Montgomery, Tex.

[73] Assignee: N-S-W Corporation, Houston, Tex.

[21] Appl. No.: 879,534

[22] Filed: Feb. 21, 1978

Related U.S. Application Data

[63] Continuation-in-part of Ser. No. 836,622, Sep. 26, 1977, abandoned, which is a continuation-in-part of Ser. No. 784,495, Apr. 4, 1977, abandoned.

[51] Int. Cl.[2] ..... B25B 13/46

[52] U.S. Cl. ..... 81/57.39

[58] Field of Search ..... 81/57.44, 57.39

[56] References Cited

U.S. PATENT DOCUMENTS 2,972,918 2/1961 Huff et al. ..... 81/57.44

3,706,244 12/1972 Wilmeth ..... 81/87.39

*Primary Examiner*—James L. Jones, Jr.

*Attorney, Agent, or Firm*—Michael P. Breston

[57] ABSTRACT

The power wrench for turning threaded connection members comprises a power cylinder having a piston rod extending from one end of the cylinder and being operably coupled to a wrench arm connectable to a connection member for turning the same. A reaction support structure has a pivotal connection with the other end of the cylinder. The reaction support structure is supported from a pair of connection members. The structure includes discretely adjustable means for varying the angular position of the cylinder so as to maintain at mid-stroke of the rod, a substantially perpendicular relationship between the piston rod and the wrench arm to thereby accommodate the power wrench to a wide range of distinctly different patterns of the connection members.

9 Claims, 7 Drawing Figures

POWER WRENCH FOR TURNING THREADED CONNECTION MEMBERS

REFERENCE TO RELATED APPLICATION

This application is a continuation-in-part of my copending application Ser. No. 836,622 filed on Sept. 26, 1977 and now abandoned, which is a continuation-in-part of my application Ser. No. 784,495 filed on Apr. 4, 1977 and now abandoned.

BACKGROUND OF THE INVENTION (a) Field of the Invention

This invention generally relates to power wrenches for turning threaded connection members on flanges and the like.

(b) Description of the Prior Art

Power wrenches for turning threaded connection members, such as nuts and bolts, are described in U.S. Pats. 2,972,918 and 3,706,244 which are only typical of such patents. U.S. Pat. No. 3,706,244 describes a power wrench having a reaction-support structure with a limited range of adjustability for different patterns of the connection members.

In power wrenches of the foregoing type it is desired to maintain a substantially perpendicular relationship between the piston rod of the power cylinder and the wrench, at mid-stroke of the rod. The desired perpendicularity is based on the fact that by limiting the rotation of the wrench arm to a relatively small angle in response to a full stroke of the piston rod, and by making this right angle relationship to become established at the rod's mid-stroke, the torque produced by the power cylinder can be fairly accurately measured by measuring only the pressure applied to the piston in the power cylinder.

In view of the limited range of adjustability afforded by the known reaction support structures for the power cylinder, there was a requirement to use different reaction-support structures for distinctly different patterns of connection members. The need to stock such different reaction-support structures and to change them in the field was very time consuming and therefore expensive.

When a power wrench is designed for a specific pattern of connection members, the reaction-support structure is such that the desired right-angle relationship between the piston rod and the wrench can be maintained for any position of the reaction structure when supported from any pair of connection members within said specific pattern. In this manner maximum torque will be obtained per unit of pressure applied to the power cylinder, and torque measurements can be sufficiently accurately made by simply measuring the pressure applied to the power cylinder.

There was a long-felt need for a power wrench having an easily-adjustable reaction-support structure over a wide range of connection member patterns, and being capable of maintaining the right-angle relationship between the piston rod and the wrench over the entire range of adjustability for the reaction support.

SUMMARY OF THE INVENTION

The power wrench for turning threaded connection members comprises a power cylinder having a piston rod extending from one end thereof and being operably coupled to a wrench connectable to a connection member to be turned thereby. The reaction-support is pivotably connected to the opposite end of the cylinder and is supported from a pair of connection members. This structure includes adjustable means for varying the angular position of the cylinder over a wide range.

In a preferred embodiment, the members of the reaction-support structure comprise an anchor leg rotatably secured at one end about a connection member and being pivotably secured at its other end to the cylinder, and a back-up leg rotatably secured at one end to another connection member and carrying adjustment means having a pivotal connection relative to the cylinder.

The length of the anchor leg is selected to accommodate distinctly different patterns of connection members so that for all the positions of the reaction support structure within its adjustability range, a substantially perpendicular angular relationship can be established between the cylinder's rod and the wrench.

The adjustment means comprise locking means extending longitudinally of the back-up leg, and a coupler means movably mounted on said back-up leg and having mating locking means. The coupler means carries the pivot providing the pivotal connection to the power cylinder.

In the preferred embodiment of the invention, the locking means comprise a rack extending longitudinally of the back-up leg and a matching toothed coupler slidable along the back-up leg.

In another embodiment of the invention, the locking means comprises a helical thread or screw on the back-up leg and a mating threaded coupler.

In yet another embodiment, the locking means on the back-up leg comprise a plurality of longitudinally-spaced bores and the coupler has matching bores and is slidable over the back-up leg. A pin extending through the matched bores locks the coupler to the back-up leg.

DETAILED DESCRIPTION OF PREFERRED EMBODIMENTS

Figure 1:
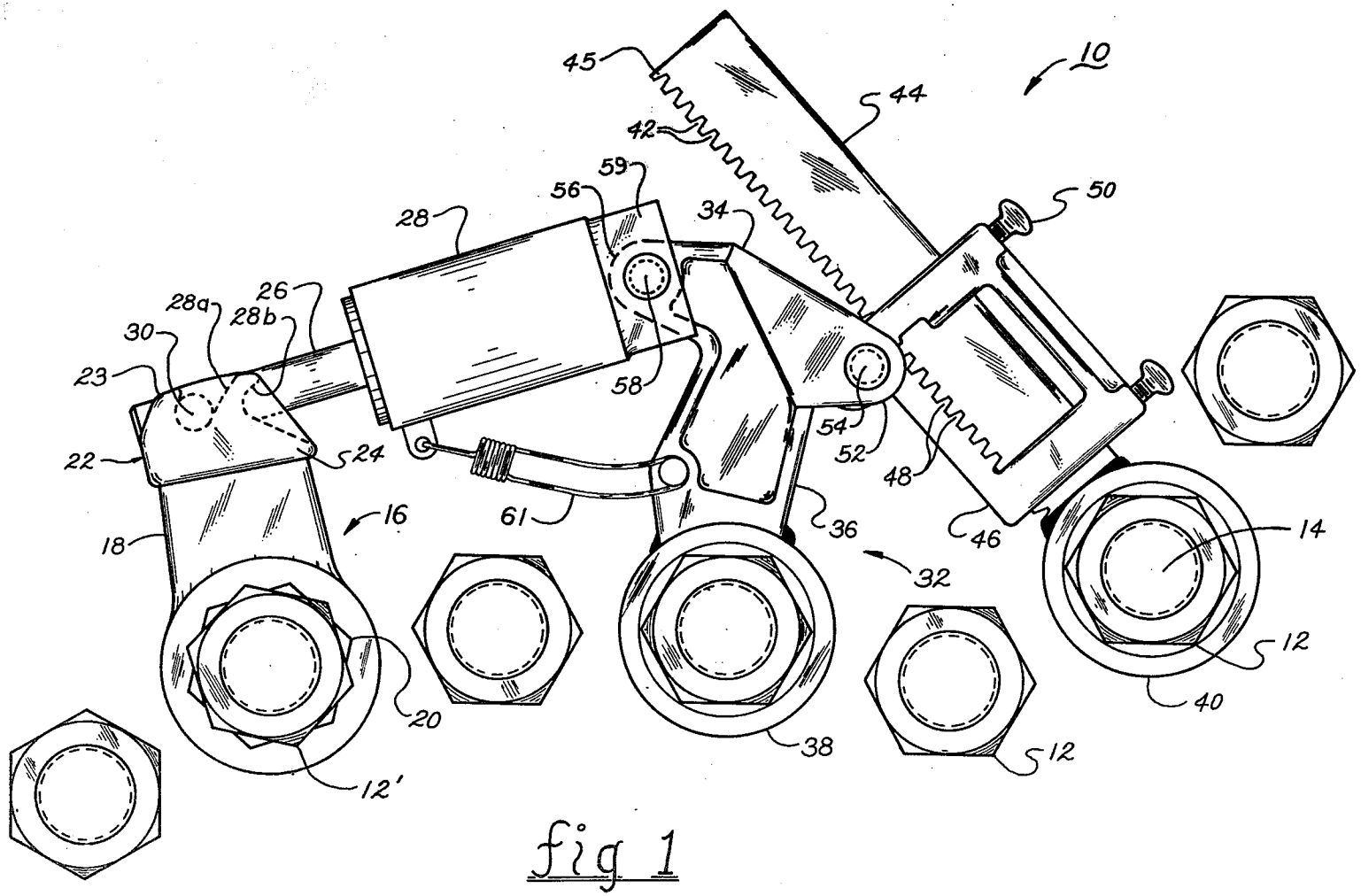
FIG. 1 is a plan view of a preferred embodiment of the power wrench in accordance with this invention.

Throughout the drawings the same or similar reference characters are used to designate the same or similar parts in order to facilitate the understanding of the invention.

The power wrench assembly, generally designated as 10, is shown positioned over an irregular pattern arrangement of connection members 12, such as nuts threadedly connected to bolts 14. The power wrench 10 includes: a power cylinder 28, a reaction-support structure 32, and a wrench, generally designated as 16. The construction and operation of the power cylinder 28 is fully described in my said U.S. Pat. No. 3,706,244, which description is incorporated herein by referrence. Wrench 16 has a wrench arm 18, one end of which has a socket 20 connectable to nut 12' desired to be turned therewith.

In one embodiment, the outer end of wrench arm 18 has a wrench head 22 operably coupled to the piston rod 26 of the power cylinder 28. In order to allow the power cylinder 28 to execute discrete rotations of the wrench arm 18, the wrench arm's head 22 is provided with two plates 24 which form therebetween a channel 23 of sufficient width to allow movement therein of the piston rod 26 which forms part of or is connected to the piston (not shown) inside the power cylinder 28. The outward ends of plates 24 are provided with several identical notches, say 28*a*, 28*b*, which are shaped to receive a cross-pin 30 carried by the outer end of piston rod 26. In practice more than two such notches are provided, as shown in my said patent.

It will be appreciated that instead of a wrench arm head 22 as before described, the ratcheting effect produced by the notches 28*a*, 28*b* can be achieved by other ratcheting means, such as is described, for example, in copending patent application Ser. No. 723,861 and now U.S. Pat. No. 4,091,890 of which I am a co-inventor, or in U.S. Pat. No. 3,745,858.

To allow the application of a pushing or pulling force to become applied by the piston rod 26 against the wrench arm 18, power cylinder 28 is pivotally supported by the reaction-support structure 32 from a pair of connection members 12.

The reaction-support structure 32 includes a discretely adjustable coupler, generally designated as 31, adapted for discretely varying the angular position of the power cylinder 28 to accommodate the power wrench 10 to distinctly different patterns of connection members 12, while maintaining intact the pivotal connection within the reaction-support structure 32. In any operable position of the reaction-support structure within the provided adjustability range, a substantially-perpendicular angular relationship will be established between the axis of piston rod 26 and the line joining the center of socket 20 and the axis of pin 30. With this perpendicular relationship, maximum torque will be exerted on a particular nut 12' per unit of pressure applied to the piston rod, and this torque can be sufficiently accurately measured by simply measuring the pressure applied to the power cylinder 28. Any appreciable deviation from this perpendicular relationship will cause considerable errors in the aforementioned torque measurements.

In the preferred embodiments of the invention, the reaction-support structure 32 comprises: an anchor leg 36 having a head portion 34 at one end thereof and an anchor ring 38 at the other end thereof, and a back-up leg 44 having a reaction ring 40 at one end thereof and locking means disposed longitudinally therealong. An adjustable coupler 31 is discretely movable longitudinally on the back-up leg 44. The coupler has mating locking means and carries a pivot for establishing the pivotal connection within the reaction support structure 32.

In a preferred embodiment (FIGS. 1-3), the locking means is a rack 45 extending longitudinally on the inner side of the back-up leg 44. Rack 45 has a plurality of teeth 42. A matching toothed coupler 46 is movable along the back-up leg 44 and is provided at one side with internal teeth 48 which match teeth 42. The coupler's opposite side can be secured to the back-up leg by any suitable securing means such as threaded, hand-operated bolts 50. The teeth 42 can be numbered so as to facilitate the operator of the power wrench 10 in positioning the coupler 46 on the back-up leg 44, whereby the desired perpendicular relationship can be maintained, as above mentioned, at least for recognized pattern arrangements of threaded connection members 12. Rings 38 and 40 are rotatably connectable to and are supported by a pair of such connection members 12, as shown.

In the embodiment of FIG. 1, one ear 52 of head 34 extends rearwardly for pivotal connection with coupler 46 about a pivot 54, while an opposite ear 56 extends forwardly for pivotal connection about a pivot 58 with the rear end 59 of power cylinder 28. A spring 61 couples cylinder 28 with the anchor leg 36 to assist in maintaining the engagement between pin 30 and the wrench head 22.

Figure 2:
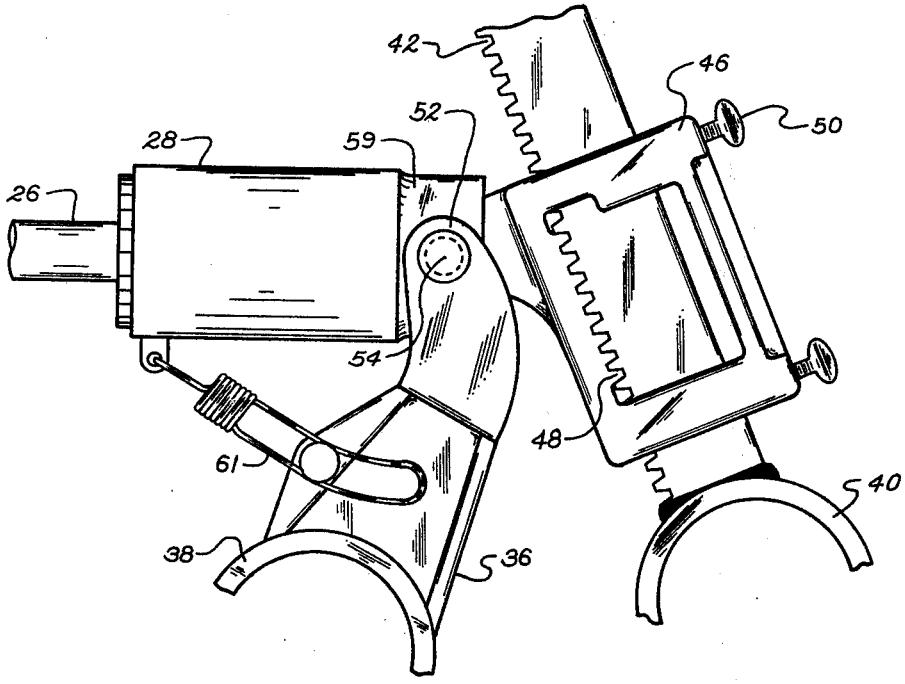
FIG. 2 is a partial plan view of a modification of the embodiment shown in FIG. 1.

In FIG. 2 is shown a modification of the embodiment shown in FIG. 1, which consists of providing the anchor leg 36 with only one pivotal connection about pivot 54, instead of the two pivotal connections about pivots 54 and 58 as shown in FIG. 1.

Figure 3:
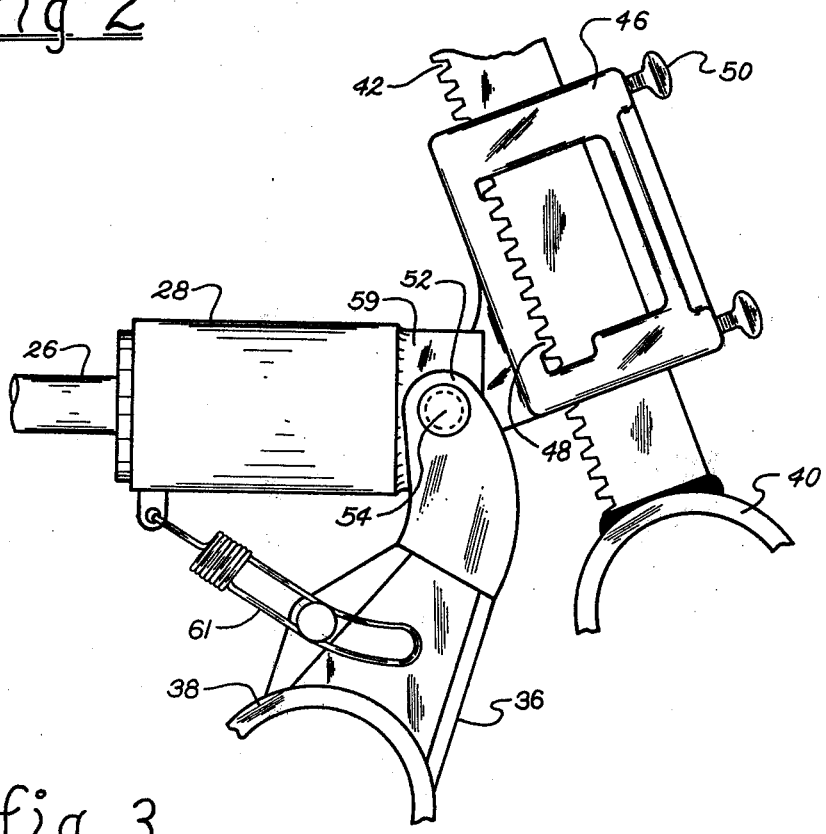
FIG. 3 is a view similar to FIG. 2 illustrating the coupler element in reversed position.

FIG. 3 additionally shows that coupler 46 can be turned over 180°, thereby considerably extending the range of adjustability afforded by the reaction-support structure 32.

The length of the anchor leg 36 is selected so that for all the positions of the adjustment means, i.e., for the entire range of reaction support adjustability, a substantially perpendicular angular relationship can be established between the longitudinal axis of piston rod 26 and a line leading from the center of socket 20 to the center of pin 30.

In operation of the preferred embodiment shown in FIGS. 1-3, the operator positions wrench 16 over the connection member 12' desired to be turned; then he positions the anchor ring 38 over another connection member 12, and finally he positions the anchor ring 40 over a third connection member 12. Without disconnecting the coupler 46 from its pivotal connection with the head 34 of the anchor leg 36 and/or the rear end of power cylinder 28, the coupler 46 is moved along the rack 45 until the teeth 48 of coupler 46 match with the numbered teeth 42 on rack 45 corresponding to the particular pattern of connection members 12 operated upon. When the positioning of coupler 46 is completed, bolts 50 are tightened and the desired substantially perpendicular angular relationship as above described becomes established automatically.

Figure 4:
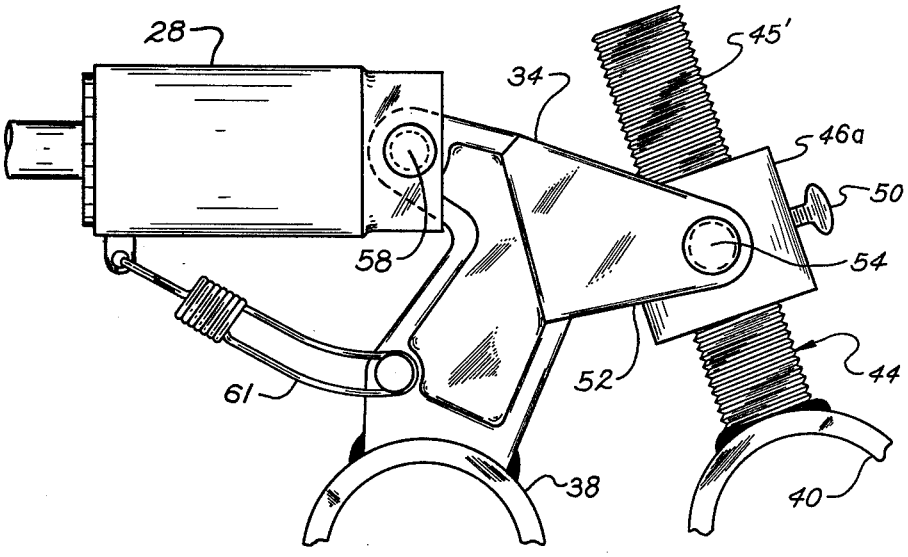
FIG. 4 is a partial front view of a modified embodiment of the invention.

In the embodiment shown in FIG. 4, the locking means is a helical screw 45' on the back-up leg 44. A matching internally threaded coupler 46*a* is movable along the back-up leg 44. The coupler can be secured to the back-up leg by the bolt 50.

Figure 5:
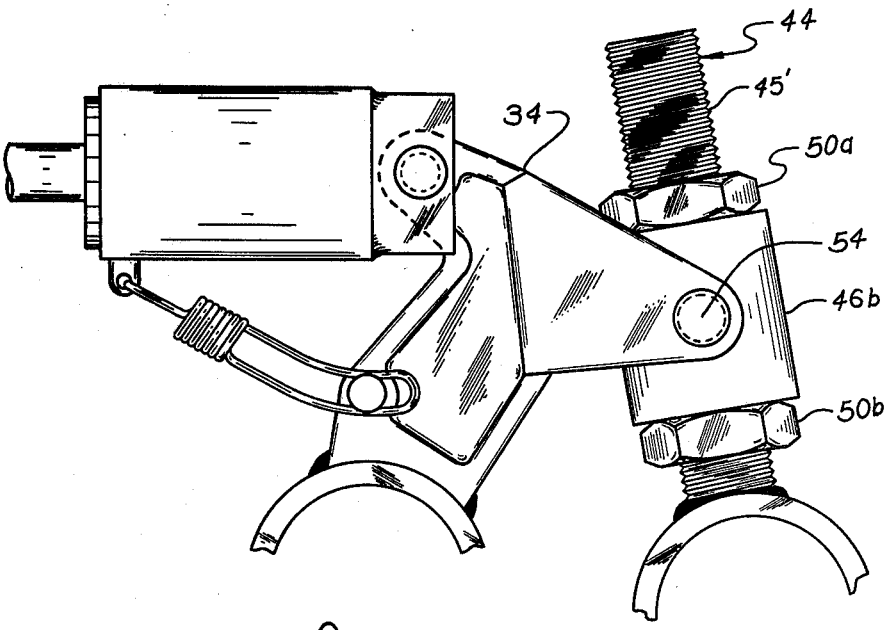
FIG. 5 is a modification of the embodiment shown in FIG. 4.

The embodiment shown in FIG. 5 is similar to the embodiment shown in FIG. 4, except that now coupler 46*b* is non-threaded. Coupler 46*b* is adjustably positioned and locked in place by a pair of end nuts 50*a*, 50*b*.

In both embodiments shown in FIGS. 4 and 5, the pivotal connection of the reaction support structure 32 is provided by a pair of diametrically opposed pivots 54, diametrically mounted along an axis passing through the center of the coupler.

Figure 6:
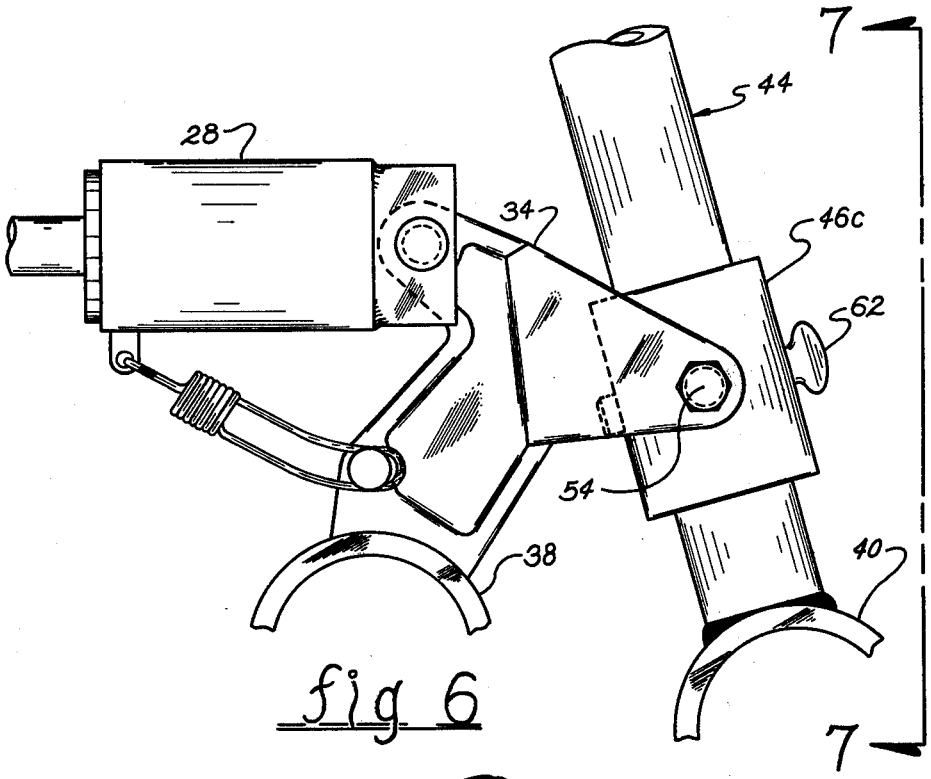
FIG. 6 is a partial front view of another embodiment of the invention.
Figure 7:
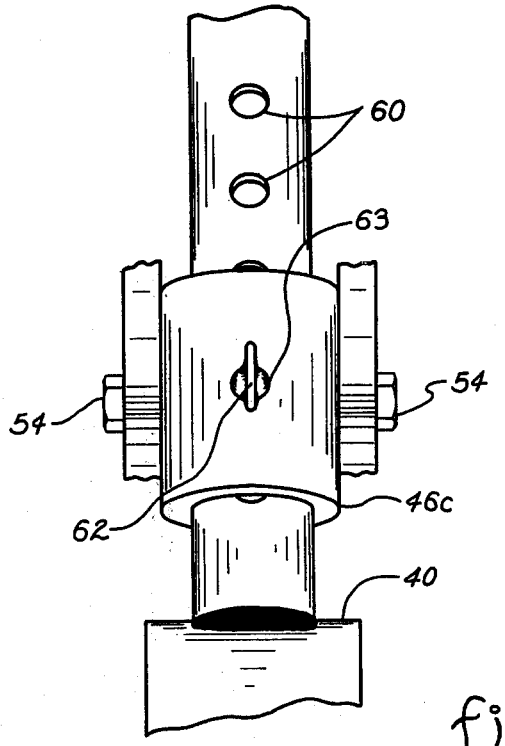
FIG. 7 is a view on line 7—7 of FIG. 6.

In the embodiment shown in FIG. 6, the back-up leg 44 is provided with a plurality of longitudinally spaced bores 60 adapted to mate and become completely aligned with a bore 63 extending through the center of the coupler 46*c*. A locking pin 62 is insertable through the aligned bores 60, 63 for securing the coupler 46c onto the back-up leg 44.

It will be readily apparent that the single reaction-support structure 32 lends itself for a wide range of irregular patterns of threaded connection members, thereby obviating the need for having to stock a great number of anchor legs and back-up legs, such as was required when using prior art reaction support structures. This invention therefore greatly improves the economy of power wrench manufacturing and of its operation.

What is claimed is:

1. A hydraulic actuator wrench for turning threaded connection members arranged in different patterns, said wrench comprising a hydraulic cylinder and a reaction support structure for supporting one end of said cylinder, the improvement wherein said reaction support structure comprises:

an anchor leg having an anchor ring at one end thereof;

a back-up leg having anchoring means at one end thereof and a set of locking means spaced longitudinally therefrom;

a hollow coupler having a set of mating locking means for engaging the locking means on said back-up leg, said coupler means being movably positioned on said back-up leg for different pattern arrangements of threaded connectors, and pivot means on said coupler for pivotably connecting said coupler means to said hydraulic cylinder.

2. The wrench of claim 1, wherein the anchoring means of said support leg is a ring.

3. A hydraulic actuator wrench for turning threaded connectors arranged in different patterns, said wrench comprising a hydraulic cylinder and a reaction support structure for supporting one end of said cylinder, the improvement wherein said reaction support structure comprises:

an anchor leg having an anchor ring at one terminal end thereof;

a back-up leg having anchoring means at one terminal end thereof and a set of locking means spaced longitudinally therefrom;

a hollow coupler having a set of mating locking means for operatively engaging the locking means on said back-up leg, said coupler being adjustably positioned on said back-up leg for different pattern arrangements of said threaded connectors, and said anchor leg being pivotably connected to said coupler and to said hydraulic cylinder.

4. A power wrench for turning threaded connection members arranged in a pattern, comprising:

(a) a power cylinder having a piston rod extending from the front end thereof and being operably engaged with a wrench connectable to a connection member to be turned thereby;

(b) a reaction-support structure rotatably supporting said power cylinder for accommodating the power wrench to a wide range of distinctly different patterns of said connection members;

(c) said reaction-support structure comprising:

(1) an anchor leg rotatably securable at one end about a connection member and being pivotably coupled at its other end relative to the rear end of said cylinder;

(2) a back-up leg rotatably secured at one end to another connection member and carrying securing means;

(d) said securing means comprising:

(1) locking means extending longitudinally of said back-up leg, (2) a coupler member having pivot means for providing a pivotal connection relative to the rear end of said cylinder, whereby to vary the angular position of said cylinder, and carrying mating locking means for engaging said locking means on said back-up leg, said coupler member being movable along said back-up leg.

5. The power wrench of claim 4, wherein said locking means is a rack.

6. The power wrench of claim 4, wherein said locking means is a screw thread.

7. The power wrench of claim 4, wherein said locking means include a plurality of bores.

8. The power wrench of claim 5, wherein the length of said anchor leg is such that for any position of said coupler member on said rack, a substantially perpendicular angular relationship is established between the longitudinal axis of said piston rod and the longitudinal axis of said wrench for a wide range of distinct pattern arrangements of said connection members.

9. The power wrench of claim 8, wherein the outer end of said anchor leg having one ear extending rearwardly from said cylinder for providing said pivotal connection with said coupler member about said pivot means, and an opposite ear extending forwardly for pivotal connection with the rear end of said power cylinder.

* * * * *